United States Patent [19]

Valenti

[11] Patent Number: 4,745,728

[45] Date of Patent: May 24, 1988

[54] MACHINE FOR CLOSING THE TOP AND SIDES OF CASES IN WHICH THE RELEVANT PRODUCTS HAVE ALREADY BEEN PACKED

[75] Inventor: Dante Valenti, Imola, Italy

[73] Assignee: In-Pak S.p.A., Italy

[21] Appl. No.: 113,622

[22] Filed: Oct. 26, 1987

[30] Foreign Application Priority Data

Oct. 30, 1986 [IT] Italy ..... 3555 A/86

[51] Int. Cl.[4] ..... B65B 7/28; B65B 7/20

[52] U.S. Cl. ..... 53/289; 53/306; 53/374; 53/383

[58] Field of Search ..... 53/374, 289, 383, 306, 53/307

[56] References Cited

U.S. PATENT DOCUMENTS

| | | | |
|---|---|---|---|
| 2,669,167 | 2/1954 | Behl | 53/374 X |
| 2,935,832 | 5/1960 | Mischke | 53/374 |
| 3,187,483 | 6/1965 | Steele et al. | 53/374 |
| 3,634,995 | 1/1972 | Curtis | 53/306 X |
| 3,681,893 | 8/1972 | De Barge | 53/374 X |
| 4,157,754 | 6/1979 | Bartsch et al. | 53/383 X |
| 4,435,943 | 3/1984 | Hoyrup | 53/374 X |
| 4,642,966 | 2/1987 | Marchetti | 53/374 |

*Primary Examiner*—Horace M. Culver
*Attorney, Agent, or Firm*—Darby & Darby

[57] ABSTRACT

The machine works on cases, or upon groups of one or more cases, by effecting an inward-folding operation on the end flaps which fold on the top edges of the transverse side pieces of every case, subsequently effecting a downward-folding operation on the flaps which fold on the end flaps, and gluing the latter to the wings of the longitudinal side pieces of the case so that the machine itself subsequently positions a corresponding lid blank on the case, centering the former both longitudinally and transversly in relation to the case, glues the central portion of the lid blank to the end flaps, folds the side portions of the lid blank until they come into contact with longitudinal side pieces of the case, and finally glues the side portions to the longitudinal side pieces.

16 Claims, 5 Drawing Sheets

S
9
8
8a
10
47
T
46a
46
42
42a
43
44
O
I
17
15
14
15a
45
W
C
48
48a

MACHINE FOR CLOSING THE TOP AND SIDES OF CASES IN WHICH THE RELEVANT PRODUCTS HAVE ALREADY BEEN PACKED

BACKGROUND OF THE INVENTION

The invention relates to a machine for closing the top and sides of cases in which the relevant products have already been packed.

DESCRIPTION OF THE PRIOR ART

It is known that special types of packaging, using cases of the type known as a "visual box", have been produced on the market for many years, above all for use by supermarkets.

These cases are open at the top and feature side pieces which are notably shorter than the height of the related case; in this way the products contained in the case can be seen from the outside, with all the obvious advantages well known to marketing experts.

In order to protect the above products, from moisture and dust in particular, the case is wrapped in transparent film, of the synthetic heat-shrinking type, for example; this film is easily removed from the packaging (normally be being torn off) when the packaging itself is put out on display, or when products are removed from the case which is not, however, on display to the public.

The above films have a tendency to hold an electric charge, such that they become (unwanted) dust collectors; in addition to this disadvantage, there is also the ecological problem connected with disposing of the above-mentioned synthetic film.

The use of a lid blank (e.g.: made from the same material as the case), of sufficient size to cover both the top part of the case as well as the longitudinal side pieces, when appropriately folded, and the application of glue to suitable areas in order to fix the lid to the case, overcome the aforementioned disadvantages.

SUMMARY OF THE INVENTION

In response to the above problems, the present invention aims to solve the technical problem of fitting a cardboard lid to the "visual box" type of case, and of fixing this cardboard lid to the case.

Indeed, the object of the invention is to propose a machine for closing the top and side of "visual box" type cases in which the relevant products have already been packed, using an original technical solution that is both reliable and extremely versatile, thast is to say using lid blanks that can be fitted to any size of case, or to cases of any size that are relocated side by side.

The above is obtained by means of a machine for closing the top and sides of cases in which the relevant products have already been packed, each of the said cases being open at the top and featuring related longitudinal side pieces with a "U" shape, the base part of the said "U" being lower than the height of the case, which features the same number of vertical end flaps, whose length is equal to the transverse dimensions of the case, and which fold in a position corresponding to the transverse edges of the related transverse side pieces; the said machine being fitted with a magazine containing a stack of flat lid blanks, the latter featuring two preformed fold lines orientated in relation to the shortest dimension, that are parellel to one another, delineating a central portion with an area equal to the horizontal section of the said cases, as wel as two side portions whose width is greater than the distance between the facing vertical surfaces of the wings of the said "U", and whose height does not exceed that of these wings; the said machine being characterised by the fact that it includes: a conveyor situated below the above-mentioned magazine, the top run of which is orientated longitudinally, and fitted with first pushing means which are equidistant from one another; a reception station located upstream of the of the said top run, in relation to its direction of movement, followed by an infeed line, designed to intermittently feed the cases onto the aforesaid top run in synchrony with the movement of the said pushing means at the beginning of the above-mentioned top run; first folding means, located at the beginning of the conveyor, and above the latter, operating in synchrony with the said reception station, designed to fold the above-mentioned end flaps towards the inside of the case until they are in a horizontal position; elastic opposing means located immediately after the first folding means, in relation to the direction of movement of the top run of the aforementioned conveyor, that extend longitudinally from an infeed station for the lid blanks, and which exert a downwards pressure on the said end flaps, which have already been folded horizontally; first means for applying glue to areas of the surface of the said end flaps which are not in contact with the above-mentioned elastic opposing means; means for withdrawing the lid blank from the bottom of the said stack, for transferring the lid blank to the said infeed station, and, finally, for depositing the lid blank on the aforesaid elastic opposing means, in synchrony with the movement below of a case, with the central portion of the above-mentioned lid blank being at least longitudinally centred in relation to the case below it; means for pushing the said lid blank in synchrony with the corresponding case, keeping the lid blank longitudinally centred in relation to the case; second folding means that work in conjunction with the said elastic opposing means and in synchrony with the withdrawal of the latter from the said lid blank and case, designed to carry out a downwards, pre-folding operation on the side portions of the lid blank, as result centring the latter transversly in relation to the related case; first pressing means, located downstream of the second folding means, and acting on the central portion of the lid blank to complete the gluing of the central portion to the end flaps below it; second means for applying glue to areas of the outer surfaces of the longitudinal side pieces of the case; third folding means, located downstream of the second folding means, and which act on the above-mentioned side portions, bringing them into contact with the facing longitudinal side pieces of the case; second pressing means, located downstream of the third folding means, and which act on the said side portions in order to complete the gluing of the latter to the related side pieces.

BRIEF DESCRIPTION OF THE DRAWINGS

The characteristics of the invention not to have emerged from that stated above, are emphasised below with specific reference to the enclosed tables of drawings, in which.

DESCRIPTION OF THE PREFERRED EMBODIMENT

Figures 1A, 2A, 4A, 4B:
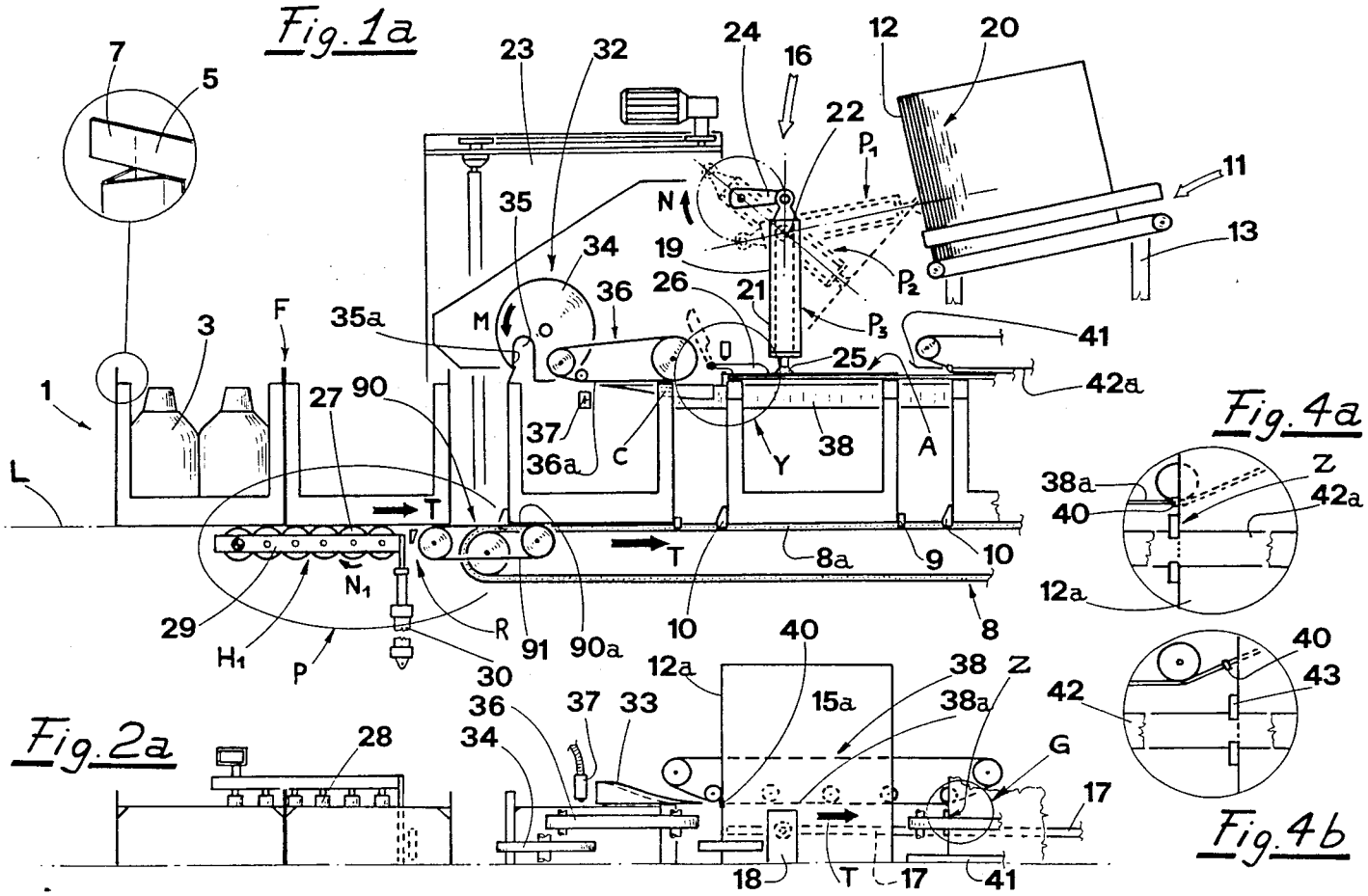
FIGS. 1*a* and 1*b* show a diagrammatic side view of the front-central and central-rear part of the machine respectively.
FIGS. 2*a* and 2*b* show a diagramatic plan of the most important construction details, corresponding to FIGS. 1*a* and 1*b*, situated to one side of the longitudinal plane of symmetry of the machine.
FIGS. 4*a* and 4*b* are large scale views of part G in FIG. 2*a* in two different operating positions.
Figures 1B, 2B, 7:
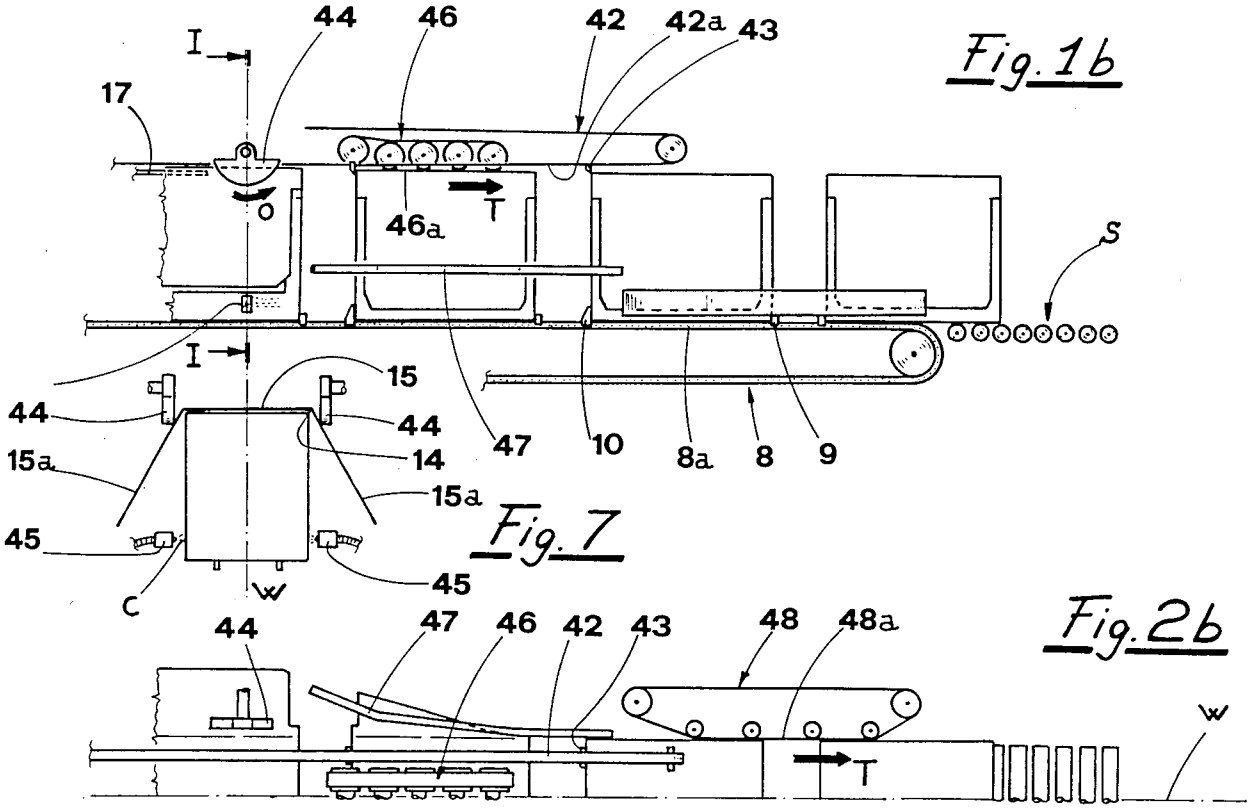
FIG. 7 is a view of section I—I shown in FIG. 1*b*.
Figure 5:
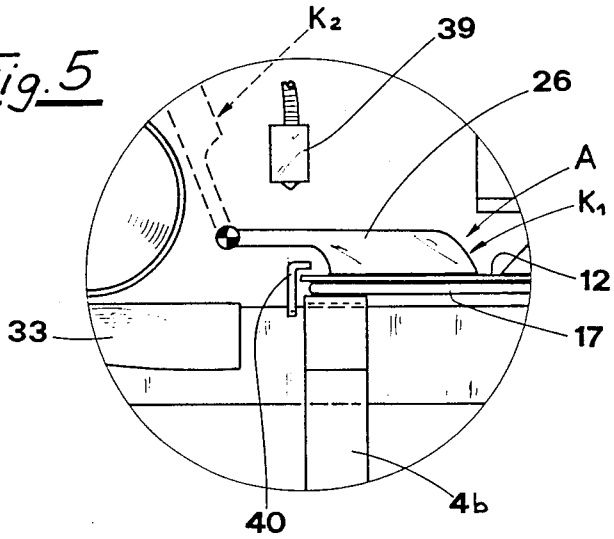
FIG. 5 is a large scale view of part Y in FIG. 1*a*.
Figure 3:
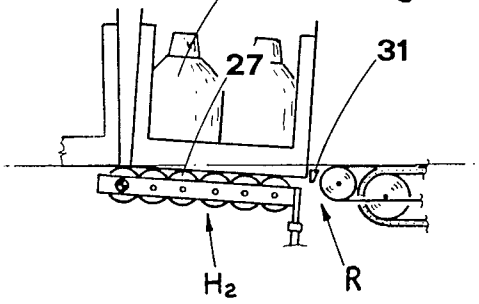
FIG. 3 is a detailed view of part P in FIG. 1*a*, with the reception station R in its bottom position H2.
Figure 6C:
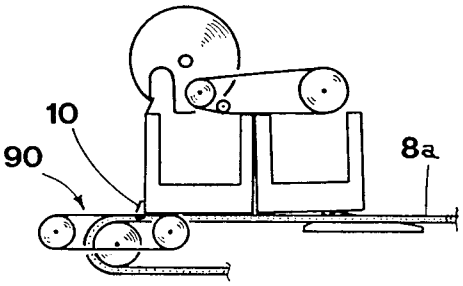
FIGS. 6*a*, 6*b*, and 6*c* illustrate, in order, the method for positioning two cases together below the first folding means.
Figure 6B:
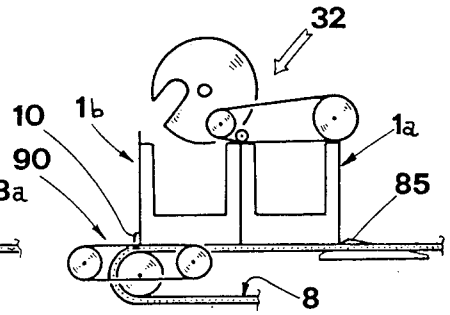
Figure 6A:
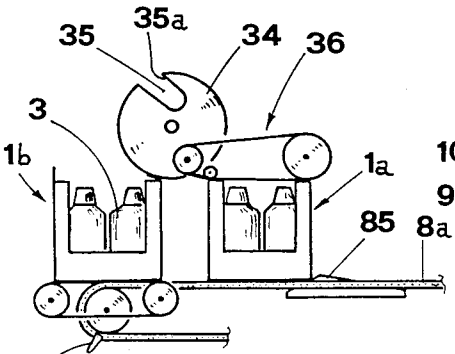

With reference to FIGS. 1 to 10, 1 indicates a partially completed case correctly packed with its related articles 3. The case 1, which is open at the top, is of the type known as a "visual box", enabling one to see the products 3 contained within; in order to carry out this function, the longitudinal side pieces 4 of the case itself have a "U" shape; the base 4*a* of the said "U" has a height that is significantly lower than that of the case.

The case in FIG. 1 features two end flaps 5, that fold at a point corresponding to the upper transverse edges 6*a* of the transverse side pieces 6 of the case itself, and which are of the same length as these side pieces, and no wider than than the width of the vertical wings 4*b* of the said "U". The ends of the said end flaps feature flaps 7, which are much less long than the height of the case.

8 indicates a conveyor (the top run 8*a* of which moves in direction T) and which is fitted with stop means 9 and pushing means 10; the distance between the latter is equal to the length "l" of the case.

A magazine 11 containing a stack 20 of flat lid blanks 12 is located above the conveyor; the magazine is supported and guided vertically by stanchions. 13, in addition being inclined as shown in FIG. 1*a*; suitable means, of known type and not illustrated, enable the distance between the magazine and the top run 8*a* of the conveyor 8 to be adjusted.

The lid blank 12 (see FIG. 9) features two preformed fold lines 14, orientated in relation to the shortest dimension, that are parallel to one another and delineate a central portion 15 and two equal side portions 15*a*; the central portion is equal to the horizontal section of the case 1; the width of the side portions 15*a* is greater than the distance between the facing vertical surfaces of wings 4*b* and no greater than the length of the case. The length of the said side portions is less than the height of the case but greater than the height of wings 4*b* as measured from the base 4a of the said "U".

To one side of the base of the magazine, there are means 16 for withdrawing the lid blank at the bottom of the stack 20, and transferring it to a lid blank infeed station A (in which there are two or more elastic plates 17 supported so that they pivot projecting from 18, and which are longitudinally orientated in the same direction T mentioned above), finally depositing the lid blank on the said plates 17; the lid blank 12 deposited on plates 17 is still in its flat form, and its preformed fold lines 14 are orientated parallel to direction T in a position that is practically symmetrical to the longitudinal plane of symmetry W of the conveyor 8.

Means 16 comprise a rod 19 which features a longitudinal slot 21 in which a horizontal pin 22 fixed to an assembly 23 perpendicular to direction T is inserted as a free fit.

One end of the rod is hinged upon one end of an arm 24, the other end of which is hinged to assembly 23 in an axis parallel to pin 22; the other end of the rod 19 features suckers 25 which can be connected, using a known method, to an air suction source, not illustrated.

As a result of the rotation of arm 24 in direction N, the rod cylically moves through positions P1, P2, P3 and then returns to P2 and P1; in the uppermost position P1, the suckers come into contact with the lid blank 12 (or, more exactly, with its side portions 15*a*) that is at the bottom of the stack 20, the suckers 25 being switched on when in this position P1.

In the lowermost postion P3, the lid blank 12 is positioned horizontally immediately above (and practically in contact with) plates 17: the suckers 25 are switched off in this position P3.

The rod 19 moves from position P3 back to position P2; in order to avoid the possibility of the suckers 25 lifting the lid blank, should the lid blank have become stuck to the suckers, station A is fitted with restaining means 26 for the lid blank; these means move (in synchrony with arm 24) from an operating position K1 (in which they retain the lid blank), and an idle position K2 in which they are outside station A.

Upstream of the conveyor 8, there is a reception station R, upstream of which in turn there is an infeed line for the above-mentioned cases 1.

The reception station R comprises a series of rollers 27, forming a supporting surface, that are keyed to shafts 28, perpendicular to direction T, supported by a frame 29 so that they are able to turn, and driven in synchrony in direction N1 by motor means using a known method, not illustrated; the said frame is hinged, at the part facing line L, to the fixed structure of the machine along an axis perpendicular to direction T, the other part being connected to a jack 30.

In addition to this, station R includes an intermediate conveyor 90 located between the frame 29 and the first part of the above-mentioned conveyor 8; the top run 90*a* of the intermediate conveyor 90 is orientated longitudinally, and is coplanar to top run 8*a* of the said conveyor 8, moving in direction T with a speed slightly above that of the latter. The intermediate conveyor comprises two chains 91, which run in a closed loop around related driven wheels, drive wheels and tensioning wheels, situated outside conveyor 8.

Switching the jack on or off brings the said frame to two extreme top and bottom positions H1 and H2.

In the top position H1, the above-mentioned supporting surface is coplanar to line L on one side, and the top run 90*a* of the intermediate conveyor 90 on the other: in this position it is possible for at least one case 1 to be conveyed from the station R to the top run 8*a* of the conveyor 8.

In the bottom position H2 (FIG. 3) the frame 29 slopes downwards; in this position the case 1 at the head of the row F of cases, supported by the said supporting surface, strikes against a stop plate 31, located between the frame 29 and intermediate conveyor 90, at a height below the top run 90*a* of the latter.

Suitable sensor means, not illustrated, mounted on the conveyor 8, trigger the operation of the jack 30; this cause the top run 90*a* and aforementioned supporting surface to be coplanar, permitting the case at the front of the row F to be transferred from the supporting surface to the top run 90*a* and then on to the top run 8*a* of converyor 8. This is facilitated by the fact that the speed at which the cases 1 are made to move by the intermediate conveyor 90 is slighter faster than the speed (in direction T) of conveyor 8; this makes it possible for the case to strike against a corresponding stop means 9 during the transfer stage.

The jack 30 is switched off as soon as just over half the base of the transfered case is resting upon the top run 90*a*; this makes it possible to transfer a single case at a time, maintaining a preset distance between the cases on the top run 8*a*.

The pushing means 10 that work in conjunction with the aforesaid stop means 9 strike against the bottom edge of the transverse side piece of the case, which is, as a consequence, pushed in direction T; this also represents the optimum position of the case on the top run 8*a*.

Means 32 for folding the end flaps 5, and means 33 which operate immediately after them, folding flaps 7, are supported on assembly 23, located above the aforementioned top run 8*a*, upstream (in direction T) of the above-mentioned means 16.

Means 32 comprise at least two discs 34, which rotate in direction M, and each features a cutout 35; the said discs first strike against the front end flap 5 at the same speed as the movement in direction T (folding it inwards on the case) and subsequently strike against the rear end flap 5 with the rear edge 35*a* of the cutout 35, folding it, too, inwards on the case.

The said means 32 also feature two belts 36 (which run in a closed loop around related driven wheels, drive wheels and tensioning wheels), the bottom runs of which 36*a* (moving in direction T with the same speed as that of the top run 8*a* below it), positioned immediately downstream of discs 34, keep the already folded end flaps 5 in a horizontal position.

Upstream of the folding means 33 there are means 37 for applying glue C to the upper edges of the outside surfaces of the wings 4*b* of the longitudinal side pieces 4 of the case.

The aforementioned means 33 have two helical surfaces; these surfaces are horizontal at first, but then gradually become vertical and parallel to the above-mentioned direction T; in this way flaps 7 are gradually folded as they move against the said helical surfaces, finally coming into contact with the edges to which the glue had previously been applied.

Pressing means are located after the aforesaid helical surfaces, composed of the inside runs 38*a* of two motorised belts 38 which run in a closed loop around related driven wheels, drive wheels and tensioning wheels, all having vertical axes; the two inside runs 38*a* are positioned longitudinally, driven in direction T (at the same speed as the bottom run 8*a* below them), and located on either side of the infeed station A, exerting a preset inwards pressure on the already folded flaps 7, enabling the latter to be glued to the top edges of the above-mentioned wings 4*b*.

It should be emphasised that the two belts 38 are located below the plane of contact of the lid blank 12 resting on plates 17, and that the aforementioned inside runs 38*a* extend downstream to a zone Z, which will be described below.

As has previously been stated, the longitudinal plates 17 are located in the infeed station A; immediately upstream of this station, there are means 39 for applying glue to areas of the upper surfaces of the already folded end flaps 5, which do not come in to contact with the aforementioned plates.

As a consequence of this, the lid blank 12 deposited on plates 17 in synchrony with the movement of the case 1 below it, does not come into contact with the freshly applied glue since the plates 17 act as spacers.

Belts 38 feature second equidistantly spaced pushing means 40, each of which, as soon as it comes round onto the internal run 38*a*, is in the same plane as a corresponding pushing means 10 on the top run 8*a* below it.

The second pushing means 40 strike against the transverse surface 12*a*, situated downstream, of the lid blank 12, which is consequently centred in relation to the case 1 below it, and moved in synchrony and in the same direction as the latter.

A fixed longitudinal stop 41, located downstream of the infeed station A, keeps the lid blank in a horizontal position, resting dynamically on plates 17.

Immediately downstream and on either side of stop 41, there are the bottom runs 42*a* of two motorised belts 42, which run in a closed loop around driven wheels, drive wheels and tensioning wheels, all with transverse axes; the aforesaid runs 42*a* are orientated longitudinally, and driven in direction T (at the same speed as that of the bottom run 8*a* located below them), and feature third pushing means 43, each of which, as soon as it is situated in the lower run 42*a*, comes into the same vertical plane as a corresponding pushing means 10 of the bottom run 8*a* below it.

Each third pushing means 43 functions as a second pushing means 40; the mutual exchange between the latter and the said third pushing means 43 occurs at the end of inside run 38*a* (that is to say in the aforementioned zone Z—see FIGS. 4*a*, 4*b*) of belts 38, which, since they slant outwards, cause a gradual decrease in the longitudinal speed of means 40.

As a result of the above, the lid blank 12 still remains longitudinally centred in relation to the case 1 below it.

It should be emphasised that the above-mentioned elastic plates 17 extend beyond zone Z in which the pushing means 43 strike against the aforementioned transverse surfaces 12*a* of the lid blank 12.

Two folders 44 operate immediately downstream of zone Z; they comprise two coaxial circular sectors (FIG. 7) that are located on either side of the longitudinal planes of movement of the side pieces 4 of the case.

The said folders rotate synchronously in direction 0, and in synchrony with the case 1 moving below them, striking against the side portions 15*a* of the lid blank 12; the action of this impact effects a pre-folding operation on the said side portions 15*a*, causing them to fold along their related pre-formed fold lines 14; this pre-folding operation takes place downstream, in relation to direction T, of the aforementioned zone Z. Since the folders 44 are positioned symmetrically in relation to the longitudinal plane of symmetry W of the conveyor 8, the pre-folding operation also causes the lid blank to be transversely centred in relation to the case; this is made possible by the fact that the lid blank 12 is still resting on plates 17, and thus able to slide in the transverse plane.

Means 45, for applying glue C to the outside surfaces of the base parts 4a of the aforesaid side pieces 4 of the case 1, are located below folders 44.

Pressing means are located downstream of the folders 44, (designed to exert a downwards pressure on the central portion 15 of the lid blank 12, enabling this central portion to be glued to the end flap 5 below it), composed of the bottom runs 46a of two belts 46 (running in a closed loop around driven wheels, drive wheels and tensioning wheels), in which the said bottom runs 46a move in direction T in synchrony with the bottom run 8a below them.

Downstream of both the said folders 44 and said means 45, there are two fixed folders 47, positioned on either side of the side pieces 4 of the case, at a lower level than the aforementioned folders 44.

The above-mentioned fixed folders 47 strike against the pre-folded side portions 15a of the lid blank 12, bringing them into contact with the base parts 4a of the side pieces 4.

The longitudinal edges 50 of the side portions 15a are glued to the aforementioned base parts 4a as a result of the inwards pressure exerted on the aforesaid edges by corresponding pressing means composed of the inside runs 48a of two motorised belts 48 that run in a closed loop around related driven wheels, drive wheels and tensioning wheels, all having vertical axes; the said inside runs 48a move in direction T in synchrony with the top run 8a of conveyor 8.

The bottom runs 42a of belts 42 slant upwards (FIG. 1b) before the end of the top run 8a; in this way pushing means 43 are moved away from the central portion 15 of the lid blank 12.

The case 1, the side pieces 4 and top part of which have been closed by the lid blank (see FIG. 10), is sent, by means of conveyor 8, to a station S where suitable means, not illustrated, either offload it so that it may be sent into storage, or palletise it.

Figure 8:
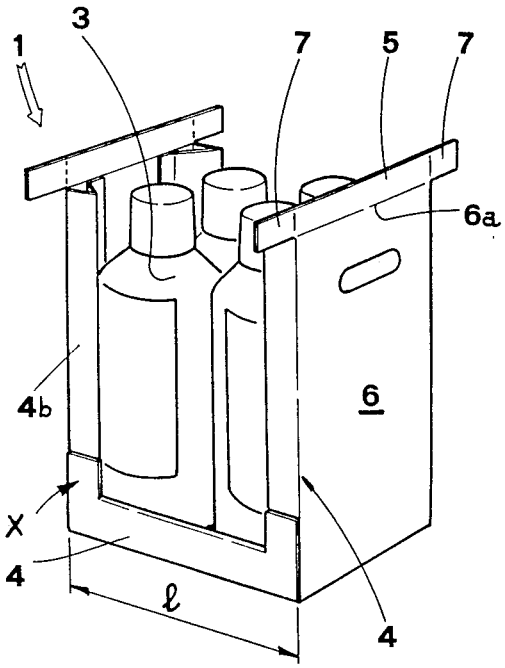
FIG. 8 is a drawing in perspective of the shape of a possible case to be sent to the reception station.
Figure 10:
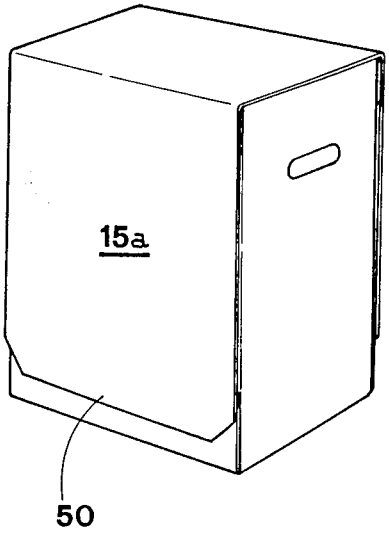
FIG. 10 is a drawing in perspective of the case in FIG. 8, closed off with the lid shown in FIG. 9, and all effected using the present machine.

The side pieces 4 of the case as shown in FIG. 8 feature a base part 4a and initial parts of the wings 4b which protrude (this protruding portion being indicated as a whole by X) in comparison with the remaining parts of these wings; the outside longitudinal edge 50 of the side portions 15a is glued to the base part 4a as described above, and is illustrated in FIG. 10.

As a result of this, the central areas of the side portions 15a are not glued to the outside surfaces of the wings 4b, this only being effected in the areas corresponding to portion X and flaps 7.

Figure 11B:
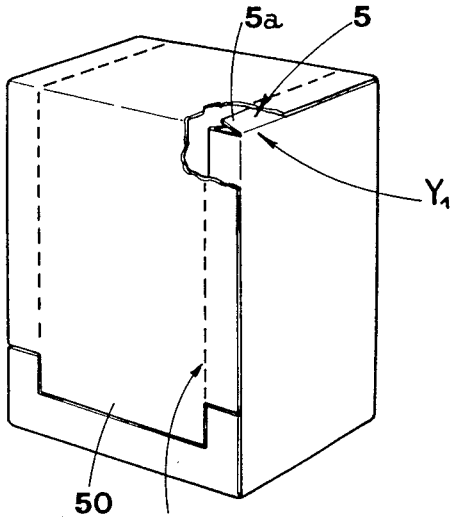
FIGS. 11*a* and 11*b* show, in order, a flat lid blank, and a case closed off using this form of lid blank.
Figure 12B:
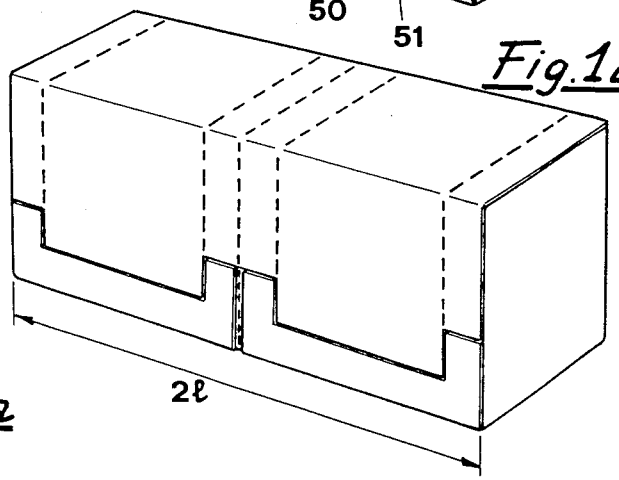
FIGS. 12*a* and 12*b* show, in order, a further flat lid blank, and a pair of cases closed off using this form of lid blank.
Figure 11A:
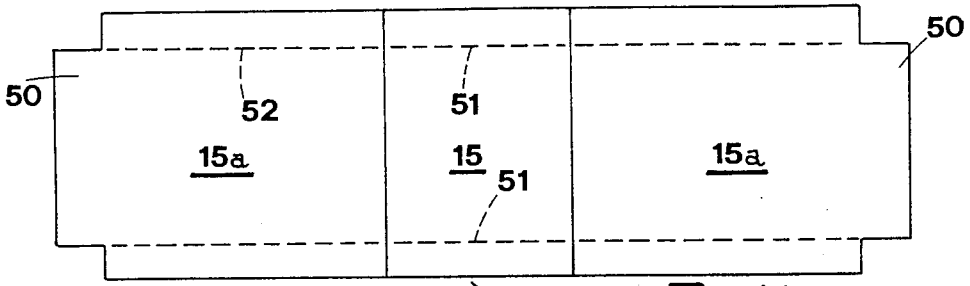

The machine described above is extremely versatile, enabling lid blanks 72 of the type illustrated in FIG. 11a to be fitted to the cases.

The longitudinal edges 50 of lid blank 72 are shaped so that they are complimentary to the the top part of portions X, the width of the side portions 15a does not exceed the length of the side pieces 4, and each transverse edge of the lid blank 72 features a line 51 of perforations 52, this line 51 being located at a distance from the adjacent transverse edges that is equal to the width of wings 4b.

The case 1 to which the lid blank 72 is fitted does not have any flaps 7, and the longitudinally edges 5a of the end flaps are angled inwards (see detail Y1 in FIG. 11b).

To fit the lid blank 72 to the case without flaps 7, means 37 and folders 33 must be disenabled, and the elastic plates 17 positioned after the bottom runs 36a of belts 36, in order to keep the already folded end flaps 5 in a horizontal position; in addition to this, means 45, described above, should be replaced with a series of means, similar to the latter, designed to apply glue to those areas of the outside surfaces of wings 4b not making up portion X; finally, the height of belts 48 should be adjusted so that their related runs 48a operate upon the outside portions 15a at a point corresponding to the area of the wings 4b to which the glue has been applied.

The case in FIG. 11b is particularly interesting in that by operating on any on the longitudinal edges 50, one can, when necessary, partially or totally detach parts of the side portion 15a and/or central portions 15 delineated by lines 51; this being made possible by the perforations 52.

In this way the products 3 contained within the case can be seen from outside, without in any way altering the aesthetic appearance of the latter; indeed detaching the lid in this way tears neither the case nor the lid itself, neither does it leave any unsightly areas of glue visible.

Figure 12A:
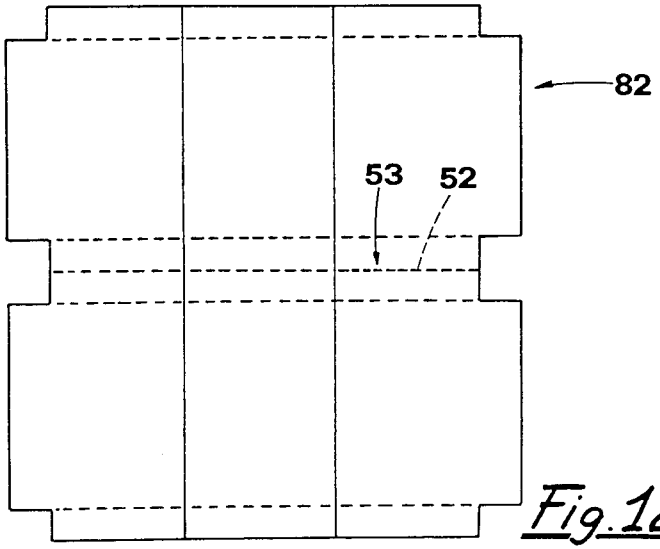

The lid blank 82 in FIG. 12a is designed to cover two cases 1a, 1b whose transverse side pieces 6 are adjacent to one another; this type of lid blank comprises two parts, divided by a line 53 of perforations 52, similar to lid blank 72 described above.

To fit the lid blank 82 to the two adjacent cases 1a, 1b, the machine described above must be modified and set up in a different way.

The conveyor 8 should not have any stop means 9, and the pushing means 10 must be spaced apart by more than the value "21"; in addition to this there should be a stop 85 located in a position corresponding to top run 8a of the conveyor 8, at a height only slightly above that of the aforementioned top run.

The folding means 32 fold the end flaps 5 of the first case 1a inwards as it moves in direction T due to the action of the top run 8a upon which it rests (FIG. 6a); the case 1a subsequently stops up against stop 85.

The second case 1b, following behind on top run 8a, is subjected to the action of related pushing means 10, is acted upon by the aforementioned folding means as described above, and moved up against the previous case 1a. The action of the pushing means 10 enables the cases 1a, 1b to overcome the obstacle presented by the aforesaid stop 85; the two cases move downstream side by side in the same manner (FIG. 6c) and in synchrony, enabling the lid blank 82 to be fitted to them.

The present machine is universal, that is to say it can be used for cases 1 of any size whatsoever; the operating means described above, whose height above the top run 8a of the conveyor 8 varies in relation to the height of the case (e.g.: assembly 23, the magazine 11, the second folders 43, and belts 38, 42, 43, 48, etc.) being especially fitted with known technical solutions for this purpose, enabling them to satisfy such needs; the same applies to those means whose distance apart from one another varies in relation to the length of the case (e.g.: the distance between means 9 and 10 of conveyor 8, the distance between pushing means 40 and 43 of belts 38 and 42 respectively, etc.).

Figure 9:
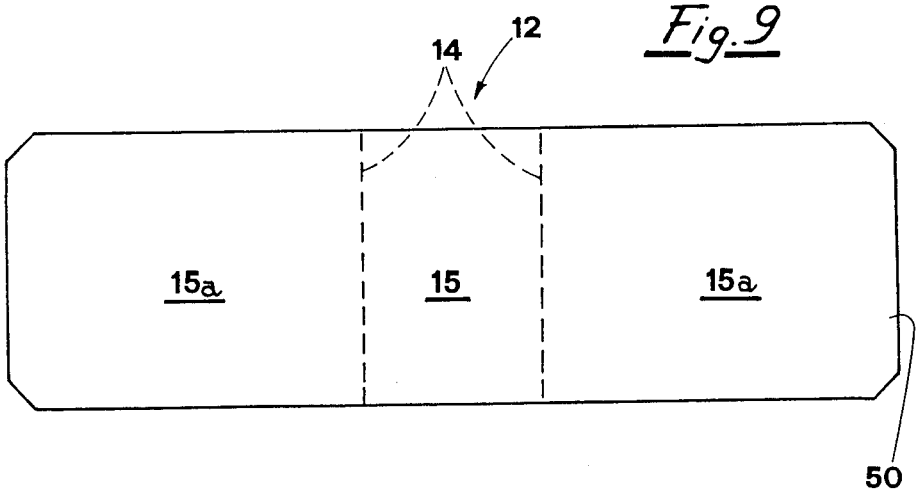
FIG. 9 is a plan of the flat lid blank used for closing the aforementioned case, and finally.

The present machine definitively fullfils the object of the invention as described above, being able to fit different shapes of carton blanks (e.g.: carton blanks as illustrated in FIGS. 9, 11a, 12a) to any size of "visual box" type cases, in order to close the top and sides of these cases.

It should be emphasised that the machine is also highly suitable for making up cases 1 without fitting a lid blank to them, in which case it is sufficient to enable folders 32, means 37 for applying glue, folders 33, and, finally, belts 38.

What is claimed is:

1. A machine for closing the top and sides of cases in which relevant products have already been packed, each of said cases being open at the top and featuring related longitudinal side pieces each one with two wings to obtain a "U" shape, the base part of said "U" being lower than the height of said case, which features an equal number of vertical end flaps, whose length is equal to the transverse dimensions of the case, and which fold in a position corresponding to transverse edges of related transverse side pieces; each of said cases being destined to be closed by a related lid obtained from a flat lid blank featuring two preformed fold lines, orientated in relation to the shortest dimension, that are parallel to one another, delineating a central portion with an area equal to the horizontal section of said case, as well as two side portions whose width is greater than the distance between said wings of said "U", and whose height does not exceed that of said wings; said machine comprising: a magazine containing a stack of flat lid blanks; a conveyor situated below the aforesaid magazine, a top run of which is orientated longitudinally, and fitted with first pushing means which are equidistant from one another; a reception station located upstream of said top run, in relation to its direction of movement, followed by an infeed line, designed to intermittently feed said cases onto the aforesaid top run in synchrony with the movement of said first pushing means at the beginning of the above-mentioned top run; first folding means, located at the beginning of said conveyor, and above the latter, operating in synchrony with said reception station, designed to fold the above-mentioned end flaps towards the inside of said case until they are in a horizontal position; elastic opposing means located immediately after said first folding means, in relation to the direction of movement of said top run of the aforementioned conveyor, that extend longitudinally from an infeed station for said lid blanks, and which exert a downwards pressure on said end flaps, which have already been folded horizontally; first means for applying glue to areas of the surface of the said end flaps which are not in contact with the above-mentioned elastic opposing means; means for withdrawing a lid blank from the bottom of said stack, for transferring said lid blank to said infeed station, and, finally, for depositing said lid blank on the aforesaid elastic opposing means, in synchrony with the movement below of a case, with said central portion of the above-mentioned lid blank being at least longitudinally centred in relation to said case below it; further means for pushing said lid blank in synchrony with said case, keeping said lid blank longitudinally centred in relation to said case; second folding means that work in conjunction with said elastic opposing means and in synchrony with the withdrawal of the latter from said lid blank and case, designed to carry out a downwards pre-folding operation on said side portions of said lid blank, as result centering the latter transversly in relation to the related case; first pressing means, located downstream of said second folding means, and acting on said central portion of said lid blank to fix said central portion to said end flaps below it, by gluing them to one another; second means for applying glue to areas of outer surfaces of said longitudinal side pieces of said case; third folding means, located downstream of said second folding means, and which act on the above-mentioned side portions, bringing them into contact with said longitudinal side pieces of said case, said side pieces facing to one another; second pressing means, located downstream of said third folding means, and which act on said side portions in order to fix the latter to said related side pieces by gluing them to one another.

2. A machine as in claim 1, in which the related ends of said end flaps feature an equal number of flaps as there are end flaps themselves, said flaps being no longer than the height of said wing of said "U" , and coplanar to corresponding said end flaps when said lid blank is flat; the said machine comprising: third means for applying glue to top edges of the outside surfaces of said wings of said "U"; fourth folding means located downstream of said third means, as well as the above-mentioned first folding means, designed to strike against the said flaps, in order to bring them into contact with the aforesaid corresponding wings of the said "U"; third pressing means, located downstream of said fourth folding means, which act upon said flaps in order to fix the latter to the corresponding wings by gluing them to one another.

3. A machine as in claim 1, wherein said reception station comprises: an intermediate conveyor, located upstream of said conveyor, a top run of which is orientated longitudinally and is coplanar to said top run of the aforesaid conveyor, and which offloads onto this latter top run, moving in the same direction and at a speed no slower than that of this same latter top run; a frame, located between said intermediate conveyor and above-mentioned line, supporting motorised shafts, perpendicular to the direction in which said intermediate conveyor moves, to which a corresponding series of rollers are keyed, forming a support surface; said frame being hinged, at an its end that is facing said line, to a structure of said machine along a transverse axis perpendicular to the aforesaid direction of movement, this making it possible to move said frame, through an action exerted by operating means, from and to a top position, in which said supporting surface is coplanar to said top run of said intermediate conveyor and above-mentioned line, and a bottom position in which said case at a head of a row formed by said cases resting on said support surface strikes up against a stop located between said frame and the beginning of said top run of said intermediate conveyor, and positioned lower down than said intermediate conveyor.

4. A machine as in claim 1, wherein said first folding means comprise: at least one disc that strikes against the said front end flap with tangential velocity, moving in the same direction as said direction of movement of said top run of said conveyor below it, said disc featuring a cutout, a rear edge of which strikes against said rear end flap of each said case; at least one belt which runs in a closed loop around related driven wheels, a drive wheel and tensioning wheel, all having transverse axes, a bottom run of which moves in the same direction as the direction in which said top run moves below it; the aforementioned bottom run being positioned horizontally, immediately downstream of said disc, and being designed to keep said end flaps, previously folded by the aforesaid disc, in a horizontal position.

5. A machine as in claim 1, wherein said means for withdrawing said lid blank at the bottom of said stack, and for subsequently transferring said lid blank onto said elastic opposing means comprise: an arm, that is part of an assembly the height of which can be adjusted in relation to said top run of said conveyor below it, and which is hinged to said assembly along an axis that is perpendicular to the aforementioned direction of movement, and which rotates in synchrony with the movement of the said first folder means; a horizontal pin fixed to said assembly so that it is perpendicular to said direction of movement; a rod, one end of which is hinged to a free end of the aforesaid operating arm, featuring a slot in which the aforementioned pin is a free fit; holding means located at a free end of said rod, designed to grip at least said side portions of the abovementioned lid blank.

6. A machine as in claim 1 wherein said further means for pushing said lid blank comprises: at least two motorized belts each of which run in a closed loop around related driven wheels, drive wheels and tensioning wheels, all of which have vertical axes, said belts being situated on either side of said infeed station, below the plane of said lid blank resting on said elastic means, and the related inside runs, which extend longitudinally to a zone located upstream of the aforementioned second folders means, and outside a spaces occupied by said side portions of said lid blank while they are being folded, the above-mentioned inside runs moving in the same direction and in synchrony with said top run of said conveyor below them; second pushing means that are mounted on each of the aforementioned belts respectively, so that they are equidistant from one another, each means being positioned, as soon as it comes round onto said inside run of said related belt, in the same vertical plane as a corresponding second pushing means of the other said belt, striking against a transverse surface, located downstream, of the above-mentioned lid blank, said first pushing means, mounted on the above-mentioned top run of the conveyor, also being positioned in the aforesaid vertical plane; at least one further motorised belt, running in a closed loop around driven wheels, a drive wheel and tensioning wheel, all having vertical axes, located above a plane occupied by said central portion of the above-mentioned lid blank, a related bottom run of which extends longitudinally from the aforesaid zone to a point corresponding to an offloading station, moving in the same direction as, and in synchrony with the aforementioned top run of said conveyor; third pushing means mounted on said further motorized belt, that are equidistant from one another, each of which, as soon as it comes round into an inside run of the related said further motorized belt, is positioned in a same vertical plane as a corresponding first pushing means mounted on said top run of said conveyor below them, striking against said transverse surface, located downstream of said central portion of the above-mentioned lid blank.

7. A machine as in claim 1, featuring a corresponding stop means for every pushing means, mounted on said conveyor and located in front of said pushing means concerned, at a distance, measured along said top run of said conveyor, equal to the length of said cases, said stop means holding back said case when it is being conveyed from the above-mentioned reception station to said top run of said conveyor.

8. A machine as in claim 1, wherein the distance between the aforementioned pushing means is greater than double the length of said cases, said machine featureing a stop, located at a point corresponding to said top run of the above-mentioned conveyor, and positioned at a height slightly above that of said top run, designed to stop a first case, the aforesaid end flaps of which have already been folded, and kept in this position, by the aforementioned first folders means, said first case being struck by a following second case that is acted upon by a corresponding pushing means which is designed to first push said second case until it strikes against the aforesaid first case, and to then push said first and second cases, side by side, pushing them over said stop.

9. A machine as in claim 6, featuring a fixed stop upstream of said zone, located above said elastic opposing means, and designing to maintain a horizontal orientation of said flat, as yet unfolded, lid blank.

10. A machine as in claim 1, wherein said elastic opposing means are composed of at least two elastic plates, each one having a front end mounted to a structure of said machine.

11. A machine as in claim 1, wherein moving means are mounted on the above-mentioned infeed station, and move through a cycle in synchrony with the movement of means, which withdraw said lid blank at the bottom of said magazine, and subsequently transfer it onto the aforementioned elastic opposing means, these said moving means moving from an idle position, in which they are outside said infeed station, to an operating position in which they act as a stop retaining said lid blank which has just been deposited on the aforesaid elastic opposing means, consequently keeping said lid blank itself in the correct horizontal position when it is released by the above-mentioned means for withdrawing and transferring said lid blank.

12. A machine as in claim 2, wherein the above-mentioned fourth folding means are composed of two fixed surfaces that strike against corresponding said flaps which fold at the end of said end flaps that have already been horizontally folded by said first folding means, said fixed surfaces extending in a helical shape, first and last portions of which are respectively horizontal and vertical, the latter being parallel to the direction of movement of said top run of said conveyor below them.

13. A machine as in claim 1, wherein said first pressing means are composed of at least one motorized belt, that runs in a closed loop around driven wheels, a drive wheel and tensioning wheel, all having transverse axes, a bottom run of said belt moving longitudinally, in the same direction as, and in synchrony with said top run of said conveyor below it, and operating so that it maintains a constant pressure on said central portion of said lid blank that is resting on the aforementioned end flaps of said case below.

14. A machine as in claim 1, wherein said second pressing means are composed of at least two motorised belts which run in a closed loop around related driven wheels, drive wheels and tensioning wheels, all having transverse axes that are located on either side of a longitudinal plane of symmetry of said conveyor; the inside runs of said belts moving longitudinally, in the same direction as, and in synchrony with said top run of said conveyor below it, and operating so that they maintain a constant pressure on said side portions of said lid blanks, holding them against said corresponding longitudinal side pieces of said case.

15. A machine as in claim 2, wherein said third pressing means are composed of at least two motorised belts, which run in a closed loop around related driven wheels, drive wheels and tensioning wheels, all having transverse axes that are located on either side of said infeed station; the inside runs of said belts moving longitudinally, in the same direction as, and in synchrony with said top run of said conveyor below it, and operating so that they maintain a constant pressure on said flaps, holding them against corresponding said vertical wings of said longitudinal side pieces of said case.

16. A machine as in claim 1, wherein said second folding means are composed of two coaxial circular sectors that are located on either side of longitudinal planes occupied by said longitudinal side pieces of said case, and which are driven so that they both turn in the same direction in synchrony with each other and the movement below them of said case.

* * * * *